US005606857A

United States Patent [19]

Harada

[11] Patent Number: 5,606,857

[45] Date of Patent: Mar. 4, 1997

[54] EXHAUST SYSTEM FOR AN ENGINE

[75] Inventor: Kenichi Harada, Susono, Japan

[73] Assignee: Toyota Jidosha Kabushiki Kaisha, Aichi, Japan

[21] Appl. No.: 500,220

[22] Filed: Jul. 10, 1995

[30] Foreign Application Priority Data

Jul. 11, 1994 [JP] Japan ..... 6-158923

[51] Int. Cl.[6] ..... F01N 7/10

[52] U.S. Cl. ..... 60/322; 60/323

[58] Field of Search ..... 60/332, 323, 282, 60/302

[56] References Cited

U.S. PATENT DOCUMENTS

| | | | |
|---|---|---|---|
| 3,799,196 | 3/1974 | Scheitlin | 60/322 |
| 3,864,909 | 2/1975 | Kern | 60/282 |
| 3,898,802 | 8/1975 | Tadokoro et al. . | |
| 3,940,927 | 3/1976 | Maurhoff | 60/322 |
| 4,022,019 | 5/1977 | Garcea . | |
| 4,074,524 | 2/1978 | Ikeya | 60/322 |
| 4,197,704 | 4/1980 | Date | 60/322 |
| 4,644,747 | 2/1987 | Petersen | 60/322 |
| 5,331,810 | 7/1994 | Ingermann | 60/322 |
| 5,419,127 | 5/1995 | Moore | 60/322 |

FOREIGN PATENT DOCUMENTS

| | | |
|---|---|---|
| 1530145 | 10/1968 | European Pat. Off. . |
| 2147726 | 3/1973 | European Pat. Off. . |
| 443573 | 12/1973 | European Pat. Off. . |
| 7900623 | 9/1979 | European Pat. Off. . |
| 171624 | 2/1986 | European Pat. Off. . |
| 63-130616A | 8/1988 | Japan . |

*Primary Examiner*—Douglas Hart
*Attorney, Agent, or Firm*—Kenyon & Kenyon

[57] ABSTRACT

An exhaust system for an engine comprising an exhaust manifold which has an outer casing and an inner casing spaced from the outer casing. The inner casing comprises a collecting portion and inner pipes. The collecting portion of the inner casing is stationarily supported by the outer casing. The upstream end portions of the inner pipes of the inner casing are axially movably supported by the outer casing.

20 Claims, 15 Drawing Sheets

EXHAUST SYSTEM FOR AN ENGINE

BACKGROUND OF THE INVENTION

1. Field of the Invention

The present invention relates to an exhaust system for an engine.

2. Description of the Related Art

In a conventional engine, for example, to maintain the exhaust gas, flowing into the catalyst arranged in the exhaust passage, at a high temperature, a double exhaust pipe, comprising an outer pipe and an inner pipe arranged to lie spaced from the inner circumferential wall of the outer pipe, is used. In such a double exhaust pipe, normally, one of the ends of the inner pipe is fixed to the inner circumferential wall of the outer pipe by welding, and the other end of the inner pipe is supported by the outer pipe via a heat insulating retainer formed of wire mesh so that the other end of the inner pipe is able to move in the axial direction relative to the outer pipe. However, the wire mesh prevents, to some extent, the exhaust gas from passing through (For an example, see FIG. 1 of the Japanese Utility Model publication No. 63-130616).

However, such a double exhaust pipe normally has a construction such that the exhaust gas flows directly over the portion of the inner wall welded to the outer pipe, and thus, the temperature of the area of the outer pipe near the welded portion of the inner pipe becomes excessively high. Nevertheless, if an area in which the temperature becomes extremely high exists on the exhaust pipe, the outer pipe must be formed of a material which is able to tolerate an extremely high temperature, and thus, a problem occurs in that the manufacturing cost of the double exhaust pipe increases considerably.

SUMMARY OF THE INVENTION

An object of the present invention is to provide an exhaust system capable of reducing the manufacturing cost thereof.

According to the present invention, there is provided an exhaust system of an engine having a plurality of exhaust ports formed therein, comprising an exhaust manifold having an outer casing and an inner casing arranged in and spaced from the outer casing, the inner casing having a collecting portion and a plurality of inner pipes which branch off the collecting portion and are connected to the corresponding exhaust port, a downstream end portion of the collecting portion being stationarily supported by the outer casing, upstream end portions of the inner pipes being axially movably supported within the outer casing.

The present invention may be more fully understood from the description of preferred embodiments of the invention set forth below, together with the accompanying drawings.

DESCRIPTION OF PREFERRED EMBODIMENTS

Figure 1:
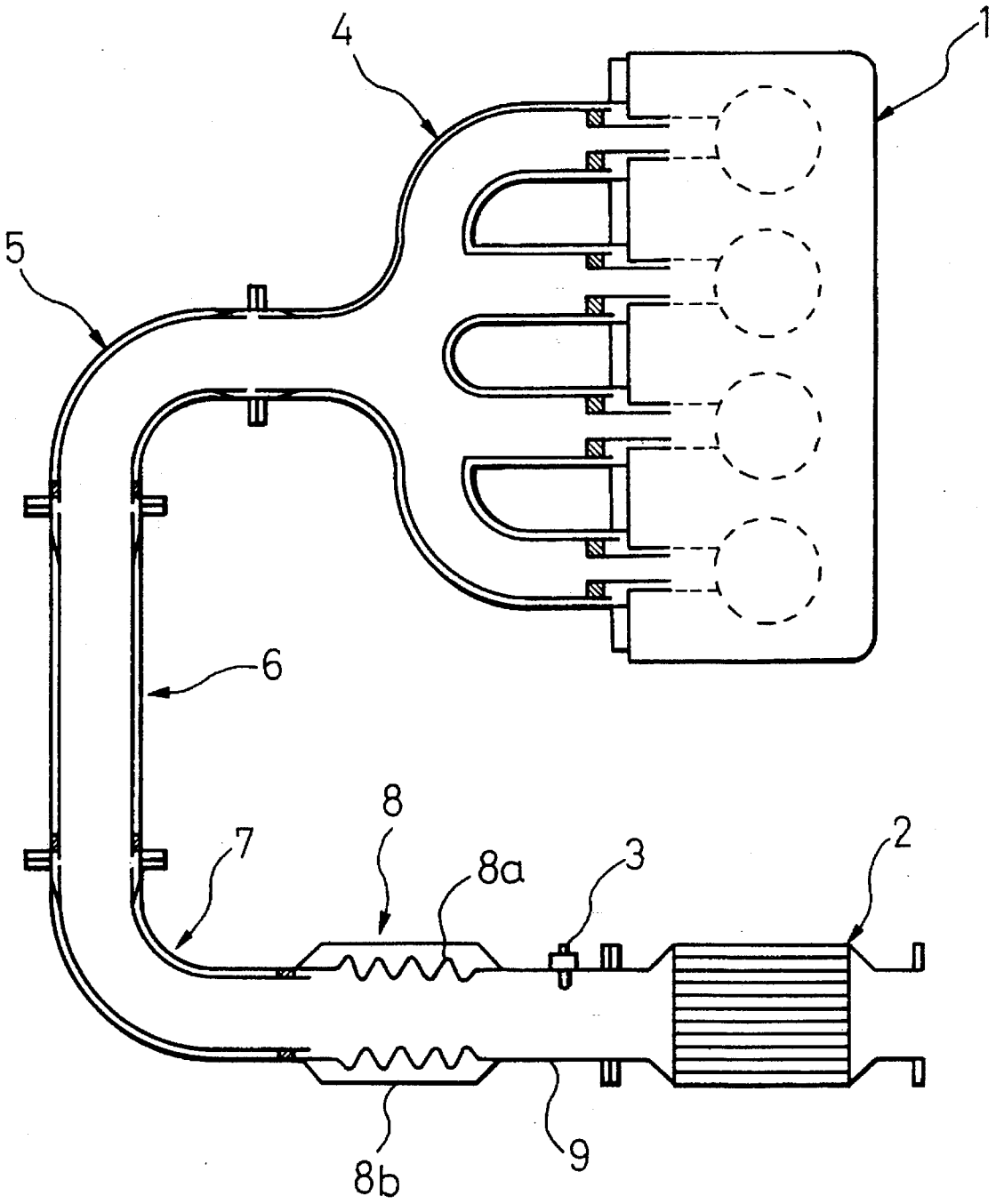
FIG. 1 is a general view of an engine, illustrating a first example of the exhaust passage.

FIGS. 1 through 5 illustrate various constructions of the exhaust system in case where the exhaust passage between the engine body 1 and the catalytic converter 2 is formed by a double exhaust pipe construction. In this case, if the exhaust passage is formed by a double exhaust pipe construction, it is difficult to attach the air-fuel ratio sensor 3 for the control of air-fuel ratio to the exhaust passage, and thus, it is preferable that the portion of the exhaust passage to which the air-fuel ratio sensor is attached be formed by a single exhaust pipe construction. Accordingly, in FIGS. 1 through 5, various constructions of the portion of the exhaust passage to be formed into a single exhaust pipe construction are illustrated. In addition, in any construction of the exhaust passage illustrated in FIGS. 1 through 5, the exhaust manifold 4 is formed by a double exhaust pipe construction.

In an example illustrated in FIG. 1, the exhaust manifold 4 is connected to a flexible pipe 8 via double exhaust pipes 5, 6 and 7. The flexible pipe 8 has a construction such that a bellows type inner pipe 8*a* is covered by a cover 8*b* formed by wire netting. The flexible pipe 8 is connected to the catalytic converter 2 via a single pipe 9, and the air-fuel ratio sensor 3 is attached to the single pipe 9.

Figure 2:
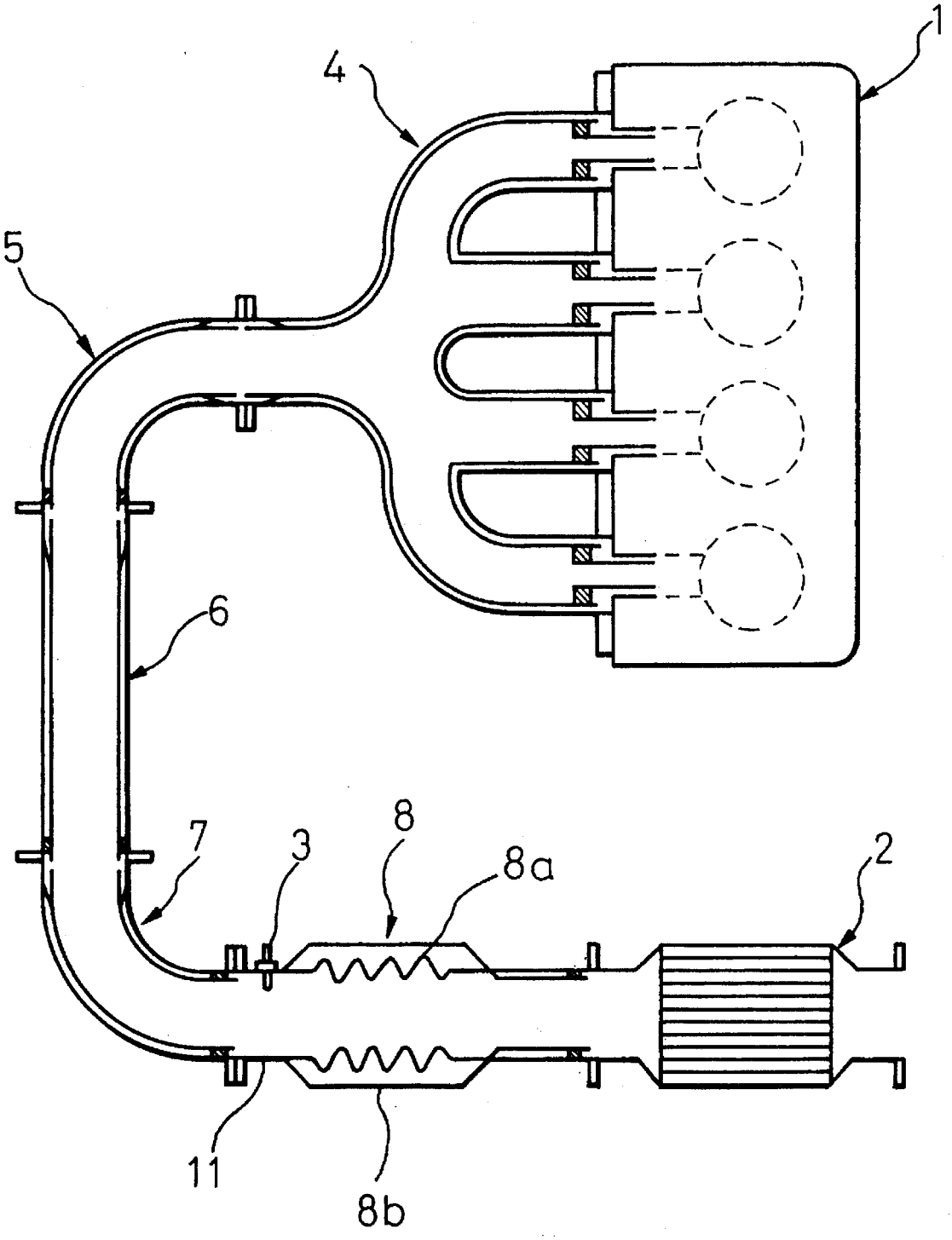
FIG. 2 is a general view of an engine, illustrating a second example of the exhaust passage.

In an example illustrated in FIG. 2, the exhaust passage between the double exhaust pipe 7 and the flexible pipe 8 is formed by a single pipe 11, and the air-fuel ratio sensor 3 is attached to the single pipe 11.

Figure 3:
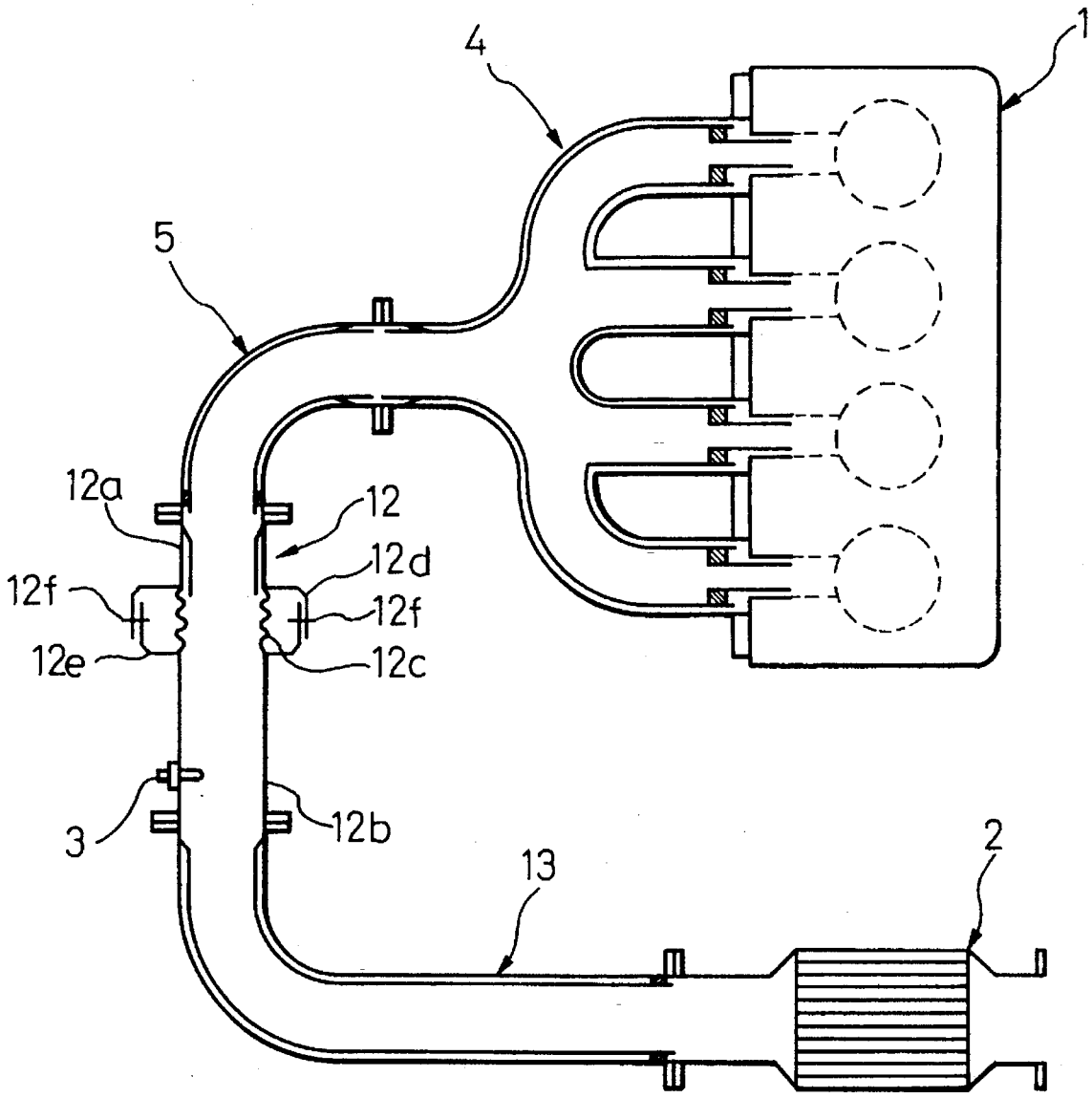
FIG. 3 is a general view of an engine, illustrating a third example of the exhaust passage.

In an example illustrated in FIG. 3, the double exhaust pipe 5 is connected to the catalytic converter 2 via a pin joint 12 and a double exhaust pipe 13. In the pin joint 12, an inlet pipe 12*a* and an outlet pipe 12*b* are interconnected to each other via a bellows-shaped pipe portion 12*c*, and a cup shaped case 12*d* fixed to the inlet pipe 12*a* and a cup shaped case 12*e* fixed to the outlet pipe 12*b* are interconnected to each other via a pair of pins 12*f*. The outlet pipe 12*b* is formed of a single pipe, and the air-fuel ratio sensor 3 is attached to the outlet pipe 12*b*.

Figure 4:
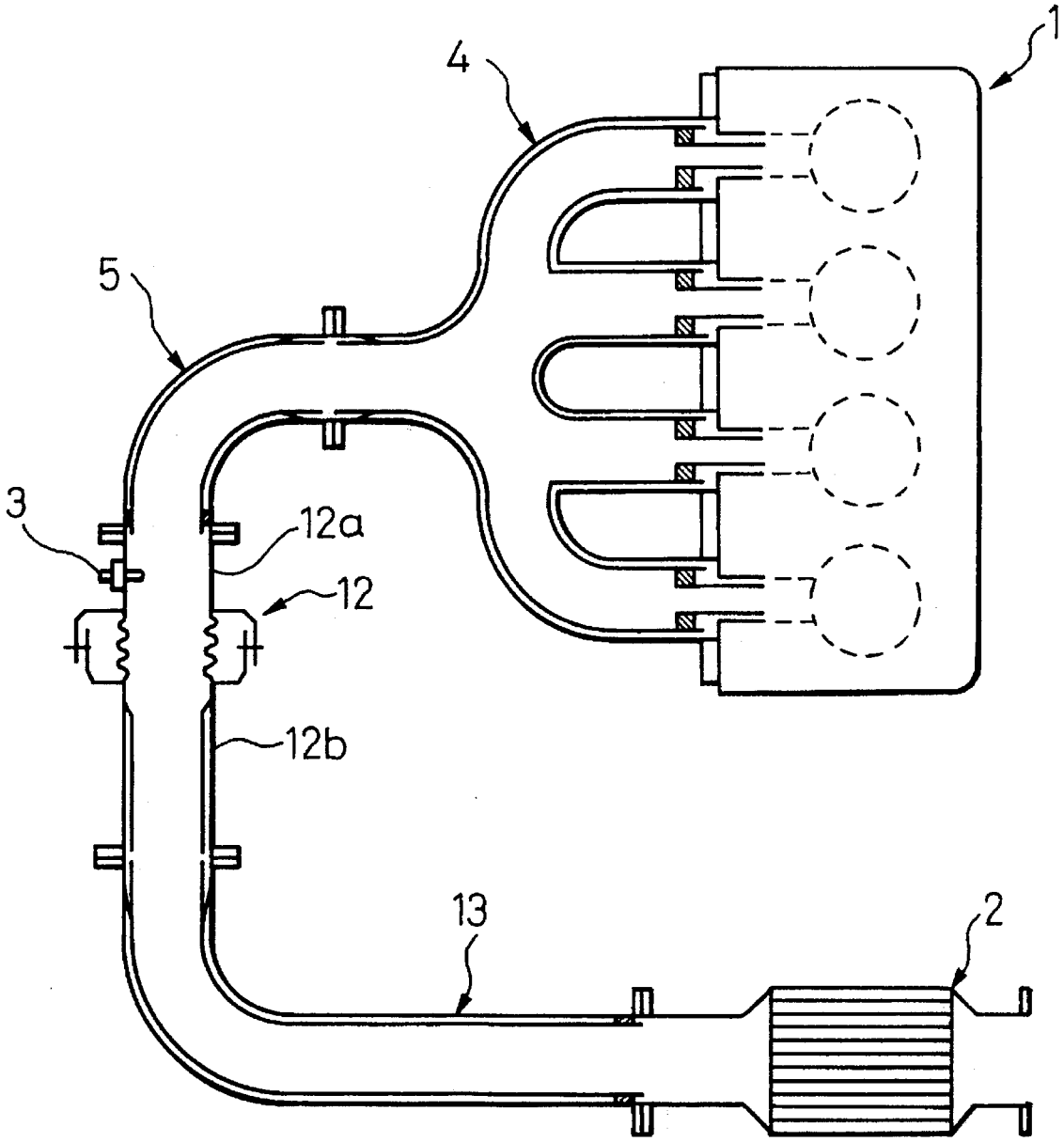
FIG. 4 is a general view of an engine, illustrating a fourth example of the exhaust passage.

In an example illustrated in FIG. 4, the inlet pipe 12*a* of the pin joint 12 is formed of a single pipe, and the air-fuel ratio sensor 3 is attached to the inlet pipe 12*a*.

Figure 5:
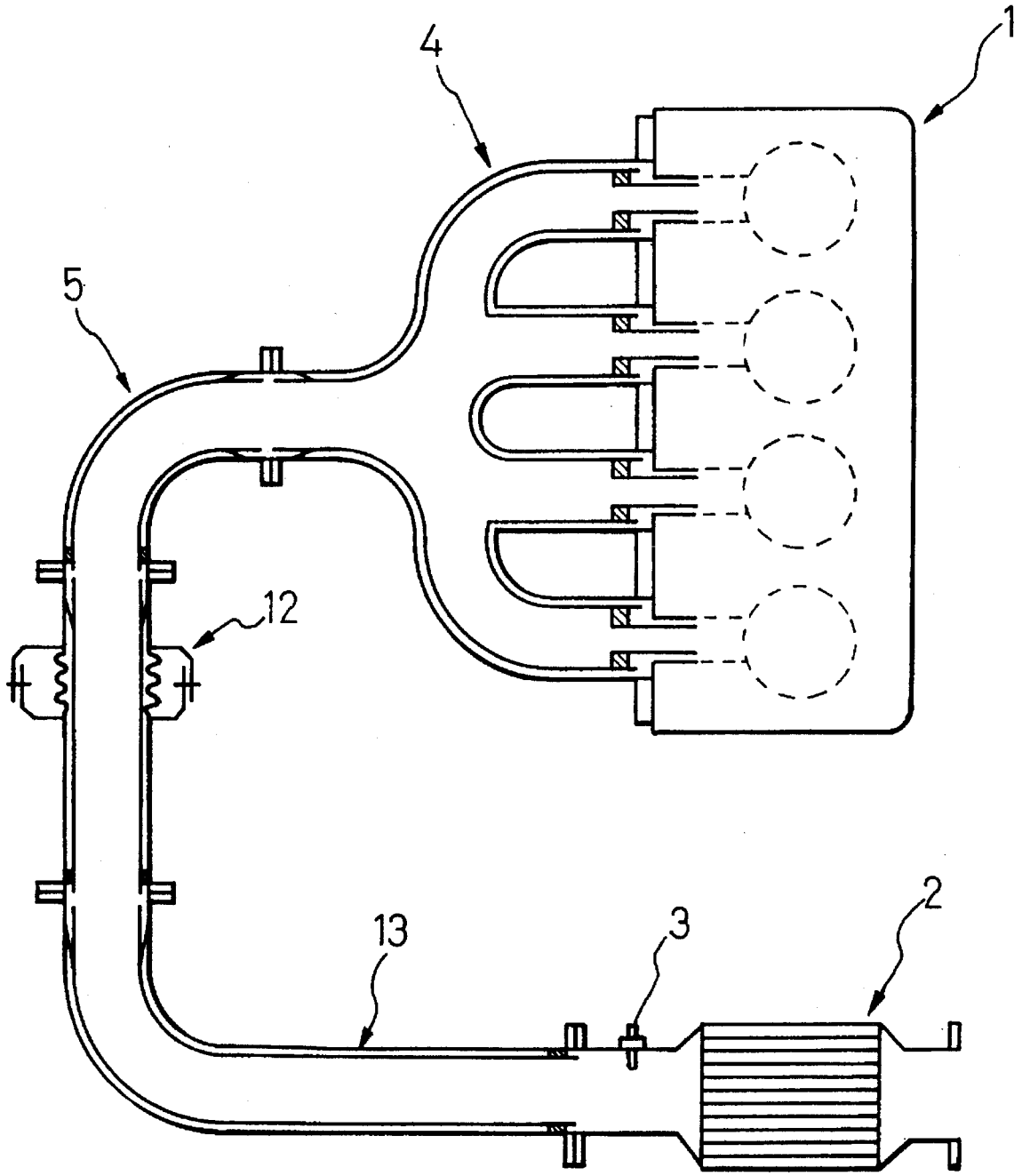
FIG. 5 is a general view of an engine, illustrating a fifth example of the exhaust passage.

In an example illustrated in FIG. 5, the pin joint 12 is formed of a double exhaust pipe construction over the entire length thereof, and accordingly, in this example, the entire exhaust passage between the engine body 1 and the catalytic converter 2 is formed by a double exhaust pipe construction. In this example, the air-fuel ratio sensor 3 is attached to the inlet portion of the catalytic converter 2.

FIGS. 6 through 14 illustrate various embodiments of the construction of the downstream end of the double exhaust pipe 5, illustrated in FIGS. 1 and 2, and of the construction of the double exhaust pipe 6, illustrated in FIGS. 1 and 2. These constructions of the double exhaust pipes, of course, can be applied to not only the double exhaust pipes 5 and 6, but also double exhaust pipes which are arranged at any positions in the exhaust passage. Namely, these constructions of the double exhaust pipe constructions can be also applied to the double exhaust pipe having a bending portion at the intermediate portion thereof. In addition, in the various embodiments hereinafter described, even if the shapes of the double exhaust pipes are slightly different, similar components are indicated with the same reference numerals. Furthermore, in FIG. 6 and the following other drawings, the arrow indicates the direction of the flow of exhaust gas.

Figure 6:
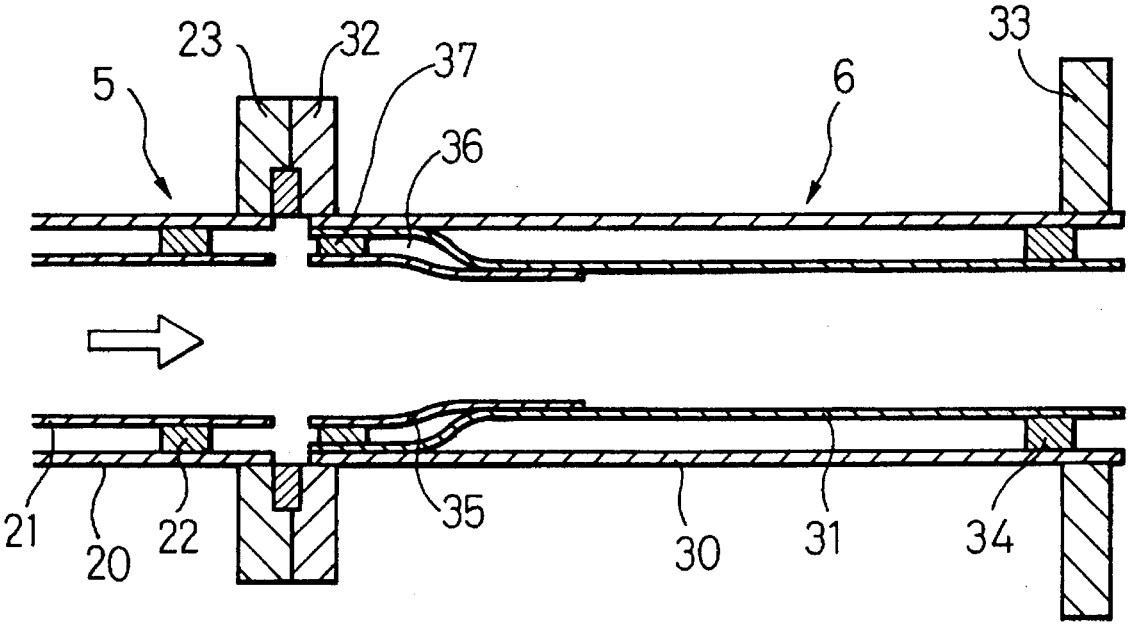
FIG. 6 is a cross-sectional side view of a first embodiment of a double exhaust pipe.

Referring to FIG. 6, the double exhaust pipe 5 comprises an outer pipe 20 and an inner pipe 21 spaced from the inner circumferential wall of the outer pipe 20 and arranged coaxially with the outer pipe 20. The downstream end portion of the inner pipe 21 is supported by the outer pipe 20 via a heat insulating retainer 22 made of wire mesh and inserted between the inner pipe 21 and the outer pipe 20. Accordingly, the portion of the inner pipe 21 around the heat insulating retainer 22 is able to move in the axial direction relatively to the outer pipe 20. A flange 23 for the connection is fixed to the downstream end of the outer pipe 20.

The double exhaust pipe 6 also comprises an outer pipe 30 and an inner pipe 31 spaced from the inner circumferential wall of the outer pipe 30 and arranged coaxially with the outer pipe 30. Flanges 32 and 33 for the connection are fixed to the upstream end and the downstream end of the outer pipe 30, respectively. The upstream end portion of the inner pipe 31 is outwardly expanded to contact the inner circumferential wall of the outer pipe 30, and the tip of the upstream end portion of the inner pipe 31 is fixed to the outer pipe 30 by welding. The downstream end portion of the inner pipe 31 is supported by the outer pipe 30 via an annular heat insulating retainer 34 made of wire mesh and inserted between the inner pipe 31 and the outer pipe 30 so that the downstream end portion of the inner pipe 31 is able to move in the axial direction relatively to the outer pipe 30. Namely, both the inner pipe 21 and the inner pipe 31 are arranged to be axially movable.

An exhaust gas guide pipe 35 having a diameter which is almost the same as the diameter of the downstream portion of the inner pipe 31 is arranged in the upstream portion of the inner pipe 31. The upstream end of the exhaust gas guide pipe 35 extends upstream from the inner circumferential wall of the inner pipe 31 to a position which is almost the same as the position of the upstream end of the outer pipe 30, and the downstream end of the exhaust gas guide pipe 35 is fixed to the inner circumferential wall of the inner pipe 31 by spot welding. An annular gap 36 is formed between the exhaust gas guide pipe 35 and the upstream end portion of the inner pipe 31, and an annular heat insulating retainer 37 made of wiremesh is inserted into the annular gap 36.

In this embodiment, the exhaust gas guide pipe 35 is arranged to cover the welded portion of the inner pipe 31 with respect to the outer pipe 30, and the inner pipe 21 and the exhaust gas guide pipe 35 are formed so that they have almost the same diameter, or the diameter of the exhaust gas guide pipe 35 is slightly larger than the diameter of the inner pipe 21. As a result, there is no danger that the exhaust gas flowing into the inner pipe 31 from the inner pipe 21 directly impinges against the welded portion of the inner pipe 31, and thus, it is possible to prevent the temperature of the portion of the outer pipe 30 near the welded portion of the inner pipe 21 from becoming excessively high.

Figure 7:
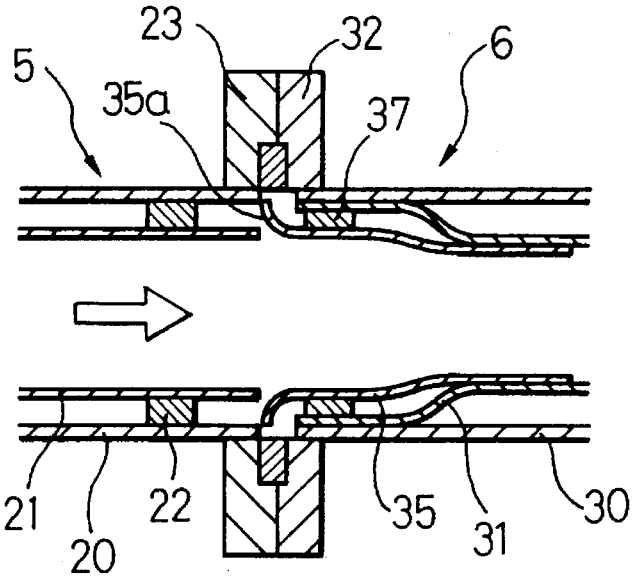
FIG. 7 is a cross-sectional side view of a second embodiment of a double exhaust pipe.

In the embodiment illustrated in FIG. 7, the upstream end of the exhaust gas guide pipe 35 is formed so that it projects upstream from the upstream end of the outer pipe 30, and the projecting tip portion 35*a* of the exhaust gas guide pipe 35 is expanded outward in the shape of a horn. Accordingly, in this embodiment, it is possible to further prevent the exhaust gas from directly impinging against the welded portion of the inner pipe 31. In addition, air in the space near the inner circumferential walls of the flanges 23, 32 is sucked into the interior of the inner pipe 35 via the annular gap formed between the inner pipe 21 and the tip end portion 35*a* due to the venturi effect. As a result, since the density of the air in the above-mentioned space becomes low, the heat conducting operation from the exhaust gas guide pipe 35 to the outer pipe 30 is suppressed.

Figure 8:
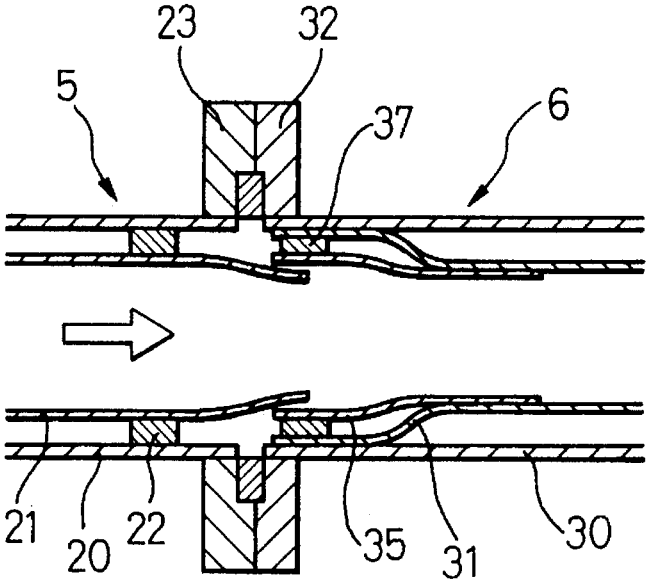
FIG. 8 is a cross-sectional side view of a third embodiment of a double exhaust pipe.

In the embodiment illustrated in FIG. 8, the downstream end portion of the inner pipe 21 of the double exhaust pipe 5 extends to the interior of the exhaust gas guide pipe 35. Accordingly, in this embodiment, it is possible to further prevent the exhaust gas from directly impinging against the welded portion of the inner pipe 31. In addition, since the diameter of the downstream end portion of the inner pipe 21 is reduced, the velocity of the exhaust gas flowing out from the downstream end of the inner pipe 21 is increased. As a result, since a greater venturi effect can be obtained as compared with the embodiment illustrated in FIG. 7, the heat conducting operation from the exhaust gas guide pipe 35 to the outer pipe 30 can be further suppressed.

Figure 9:
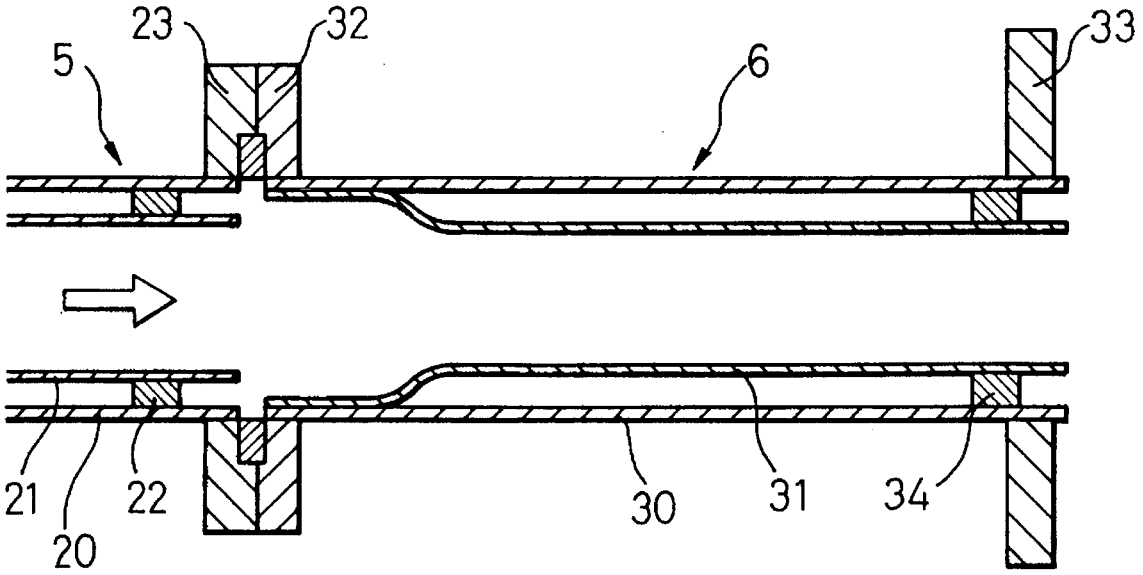
FIG. 9 is a cross-sectional side view of a fourth embodiment of a double exhaust pipe.

In the embodiment illustrated in FIG. 9, no exhaust gas guide pipe 35, as illustrated in FIGS. 6 through 8, is provided. However, in this embodiment, since the inner pipe 21 has a diameter which is larger than the diameter of the outwardly expanding upstream end portion of the inner pipe 31, the exhaust gas flowing into the inner pipe 31 from the inner pipe 21 does not directly impinge against the welded portion of the inner pipe 21. Accordingly, in this embodiment, the inner pipe 21 forms an exhaust gas guide pipe for preventing the exhaust gas from directly impinging against the welded portion of the inner pipe 31.

Figure 10:
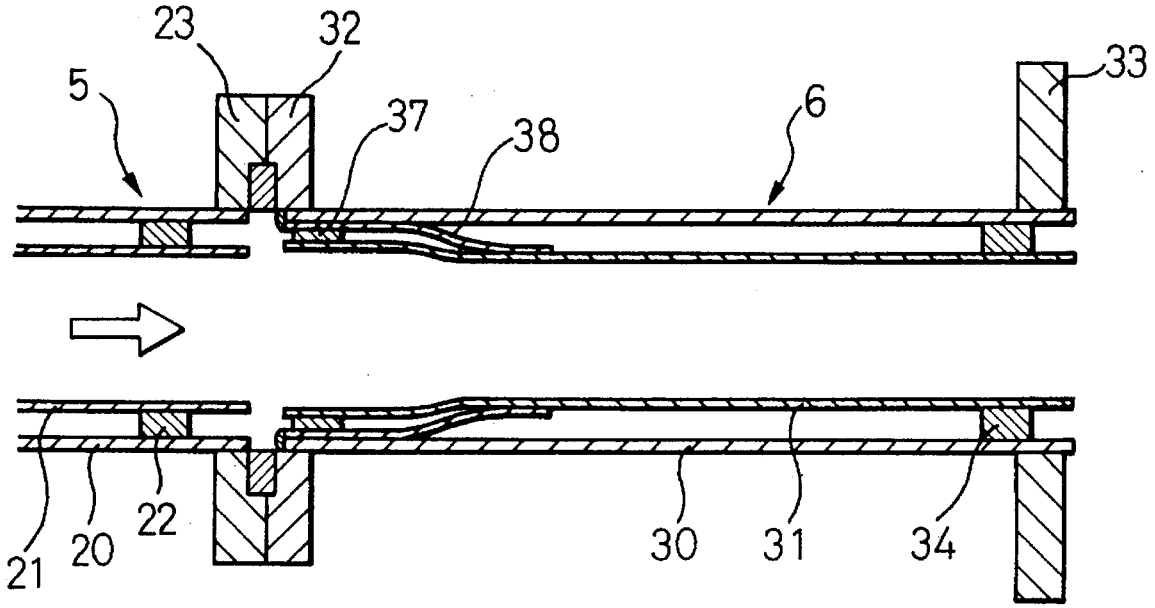
FIG. 10 is a cross-sectional side view of a fifth embodiment of a double exhaust pipe.

In the embodiment illustrated in FIG. 10, the upstream end portion of the inner pipe 31 is supported by a tubular supporting member 38. The upstream end portion the tubular supporting member 38 is expanded outward, and of the upstream end of the supporting member 38 is fixed to the outer pipe 30 by welding. The downstream end of the inner pipe 31 is fixed to the outer circumferential wall of the inner pipe 31 by spot welding. In this embodiment, the inner pipe 31 is formed so that the upstream end portion thereof covers the welded portion of the outer pipe 30 with respect to the outer pipe 30.

Figure 11:
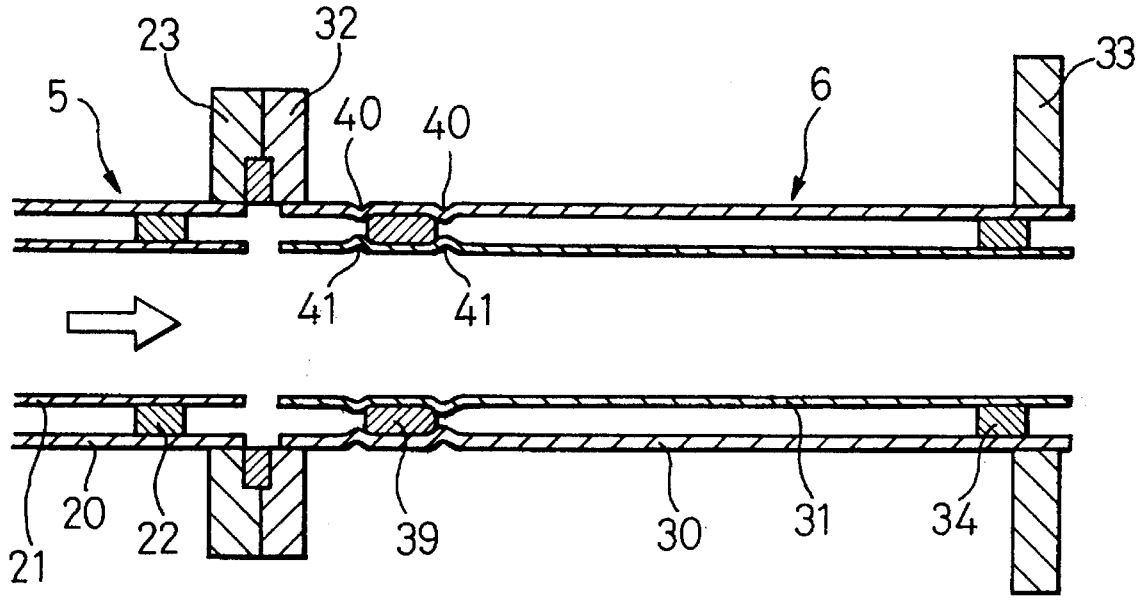
FIG. 11 is a cross-sectional side view of a sixth embodiment of a double exhaust pipe.

In the embodiment illustrated in FIG. 11, the inner pipe 31 is arranged so that it is spaced from the entire inner circumferential wall of the outer pipe 30, and the inner pipe 31 is supported by the outer pipe 30 via only a pair of annular heat insulating retainers 34, 39 made of wire mesh and inserted between the inner pipe 31 and the outer pipe 30. Beads 40, 41 projecting on the heat insulating retainer 39 side are formed on the outer pipe 30 and the inner pipe 31 on each side of the heat insulating retainer 39 to retain the inner pipe 31 in place, and the heat insulating retainer 39 is prevented from moving by the beads 40, 41.

Figure 12:
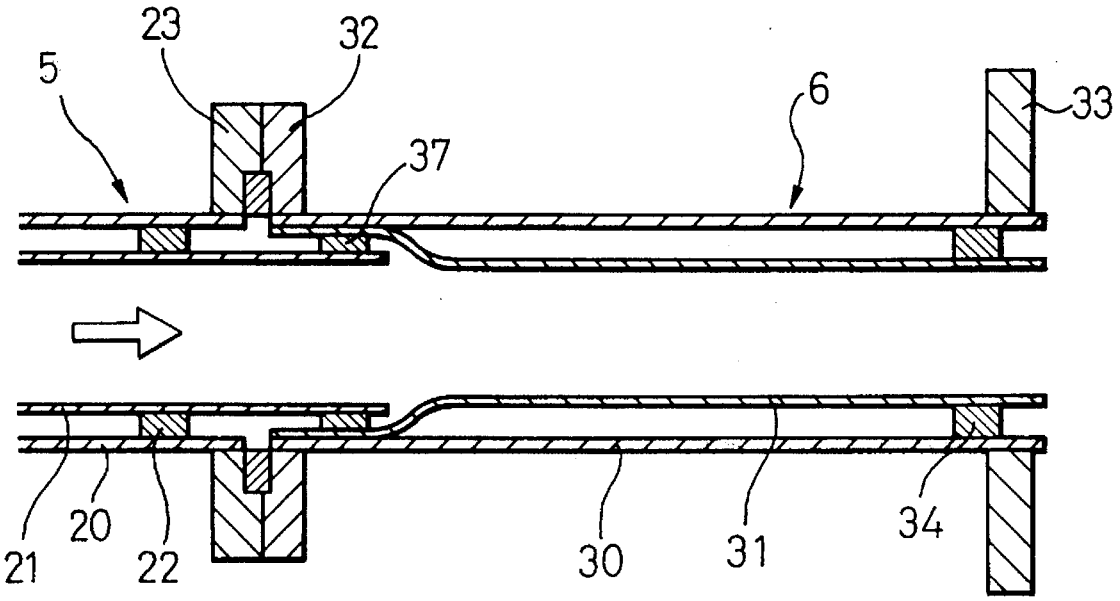
FIG. 12 is a cross-sectional side view of a seventh embodiment of a double exhaust pipe.
Figure 13:
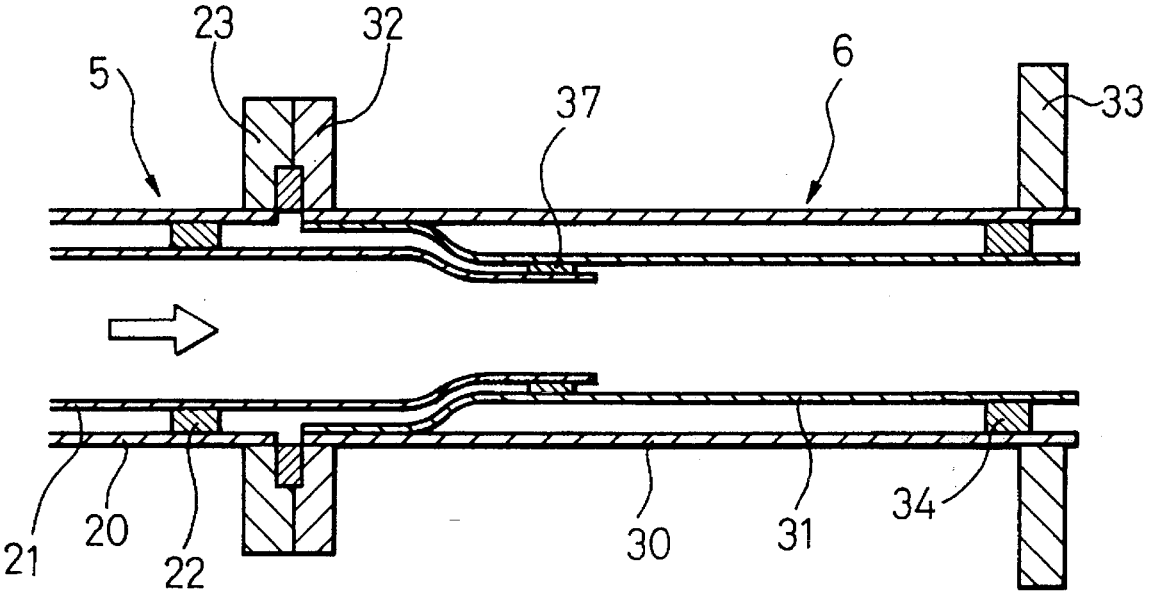
FIG. 13 is a cross-sectional side view of a eighth embodiment of a double exhaust pipe.
Figure 14:
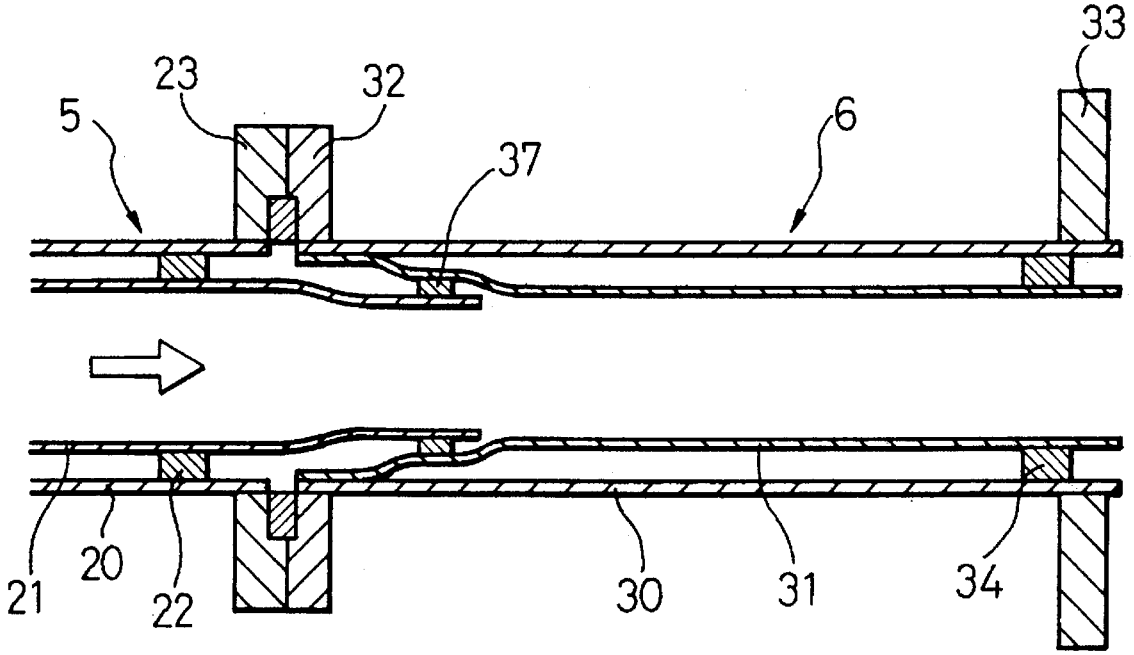
FIG. 14 is a cross-sectional side view of a ninth embodiment of a double exhaust pipe.

In the embodiment illustrated in FIG. 12, the upstream end of the inner pipe 31 is fixed to the outer pipe 31 by welding, and the inner pipe 21 of the double exhaust pipe 5 is formed so that it projects into the outwardly expanding upstream end portion of the inner pipe 31. A heat insulating retainer 37 is inserted between the inner pipe 3t and the projecting portion of the inner pipe 21. In addition, FIG. 13 illustrates the case where the inner pipe 21 is formed so that it extends to the minimum diameter portion of the inner pipe 31, and FIG. 14 illustrates the case where the inner pipe 21 is formed so that it extends to an intermediate diameter portion of the inner pipe 31.

Figure 15:
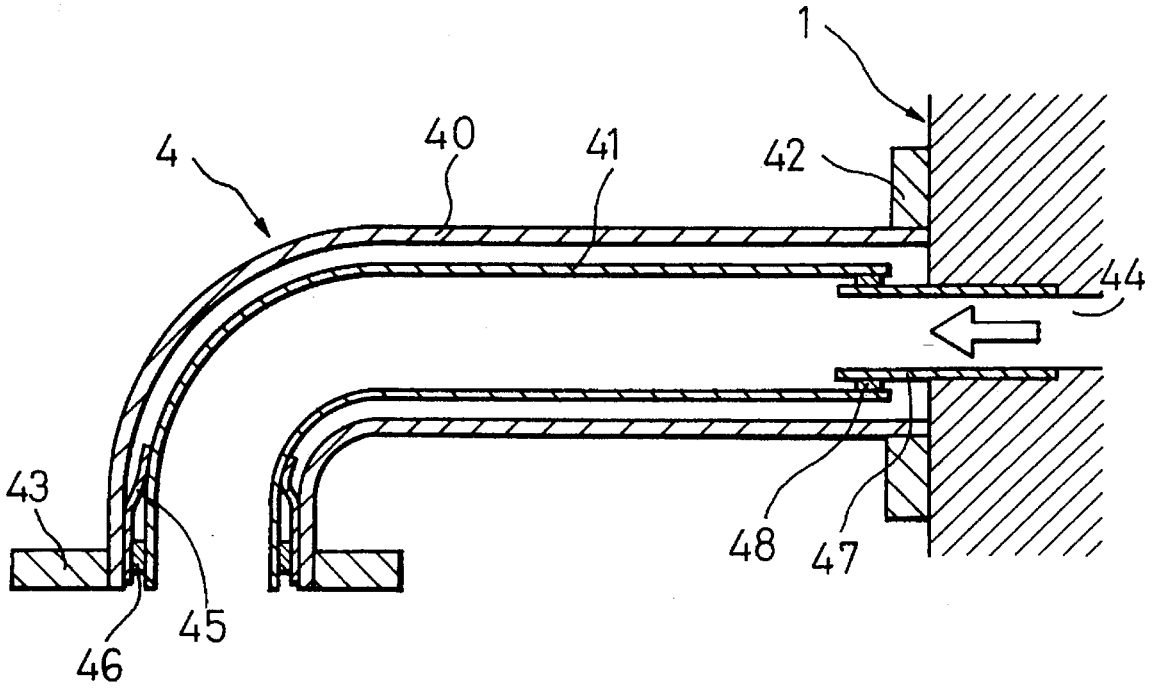
FIG. 15 is a cross-sectional side view of a first embodiment of an exhaust manifold.

FIG. 15 illustrates a double exhaust pipe construction of the exhaust manifold 4 illustrated in FIGS. 1 through 5. In FIG. 15, reference numeral 40 designates an exhaust manifold outer casing, 41 an exhaust manifold inner casing having a collecting portion and inner pipes branched off from the collecting portion, 42 and 43 flanges for the connection, and 44 an exhaust port formed in the engine body 1. The downstream end portion of the collecting portion of the inner casing 41 is supported by the outer casing 40 via a tubular supporting member 45. The downstream end portion of the supporting member 45 is expanded outward to contact the inner circumferential wall of the outer casing 40, and the downstream end of the supporting member 45 is fixed to the outer casing 40 by welding. The upstream end of the supporting member 45 is fixed to the outer circumferential wall of the collecting portion of the inner casing 41 by welding. An annular heat insulating retainer 46 made of wire mesh is inserted between the collecting portion of the inner easing 41 and the supporting member 45. In this embodiment, it is possible to prevent the exhaust gas from directly impinging against the welded portion of the supporting member 45.

In this embodiment, a supporting pipe 47 is inserted into the exhaust port 44, and the upstream end portion of the inner pipe of the inner casing 41 is supported on the outer circumferential wall of the supporting pipe 47 via an annular heat insulating retainer 48 made of wire mesh. As can been seen from FIG. 1, each inner pipe of the inner casing 41 extends toward the different cylinders. Accordingly, since the amount of heat which the inner pipe of the inner casing 41 receives differs between the inner pipes, the amount of thermal expansion differs between the inner pipes. However, as illustrated in FIG. 15, where the collecting portion of the inner casing 41 is stationarily supported by the outer casing 40 of the exhaust manifold 4, and the upstream end portion of each inner pipe of the inner casing 41 is arranged so that it is able to move in the axial direction, even if the amount of thermal expansion differs between the inner pipes, each inner pipe is able to freely expand. As a result, there is an advantage that an excessive stress does not occur in any inner pipe of the inner casing 41.

Figure 16:
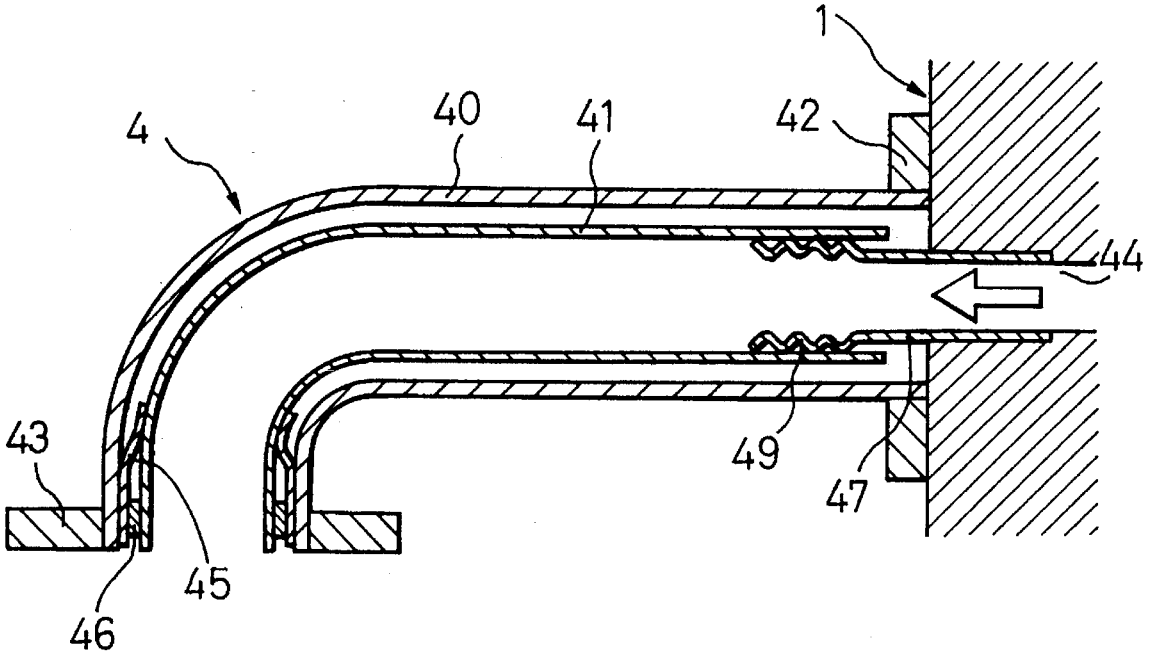
FIG. 16 is a cross-sectional side view of a second embodiment of an exhaust manifold.

In the embodiment illustrated in FIG. 16, the projecting tip portion of the supporting pipe 47 is formed in the form of a bellows shape, and the upstream end portion of the inner pipe of the inner casing 41 is supported on the outer circumferential wall of the bellows shaped projecting tip portion 49.

Figure 17:
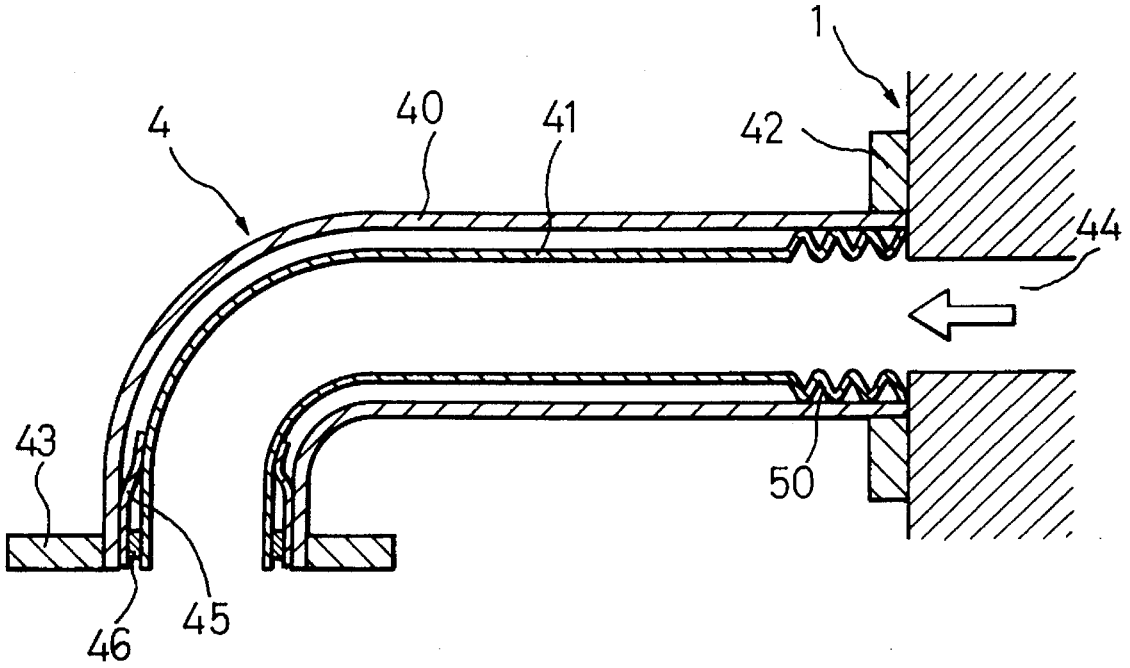
FIG. 17 is a cross-sectional side view of a third embodiment of an exhaust manifold.

In the embodiment illustrated in FIG. 17, the upstream end portion 50 of the inner pipe of the inner casing 41 is formed in the form of a bellows shape, and the bellows shaped upstream end portion 50 of the inner pipe of the inner casing 41 is urged onto the outer side wall of the engine body 1. Accordingly, even if the inner pipe of the inner casing 41 is caused to expand and shrink due to the thermal expansion, the upstream end of the inner pipe of the inner casing 41 continues to be urged onto the outer side wall of the engine body 1, and thus, there is no danger that the exhaust gas flows into the space between the inner casing 41 and the outer casing 40. In this embodiment, the inner diameter of the bellows 50 is determined so that it is equal to or less than the inner diameter of the exhaust port 44.

Figure 18:
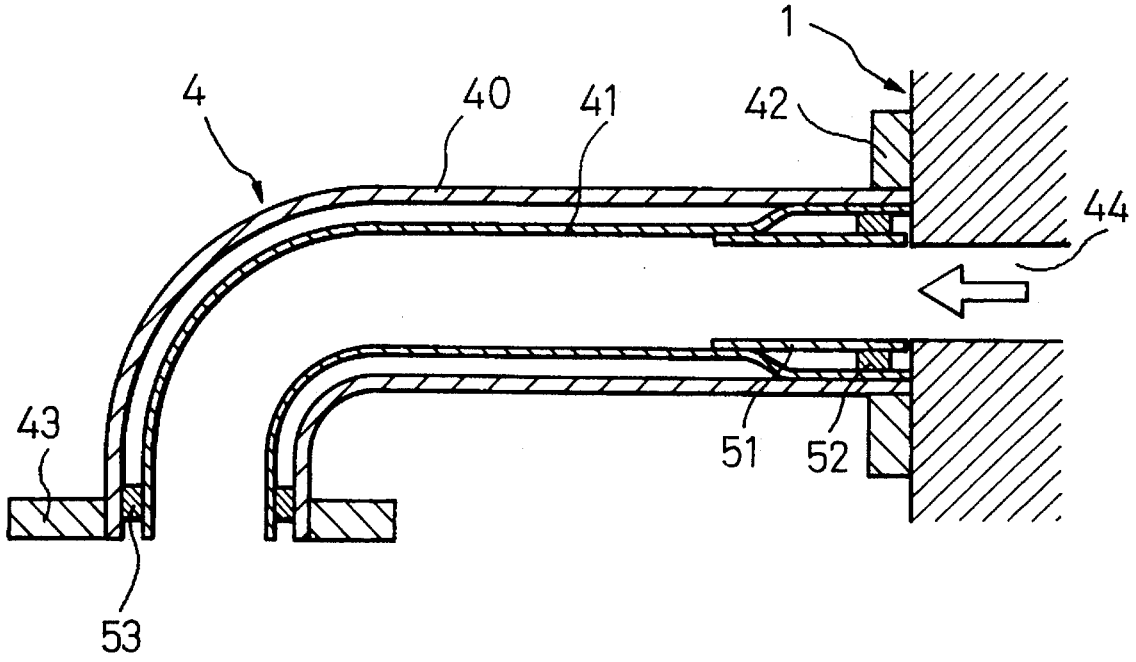
FIG. 18 is a cross-sectional side view of a fourth embodiment of an exhaust manifold.
Figure 19:
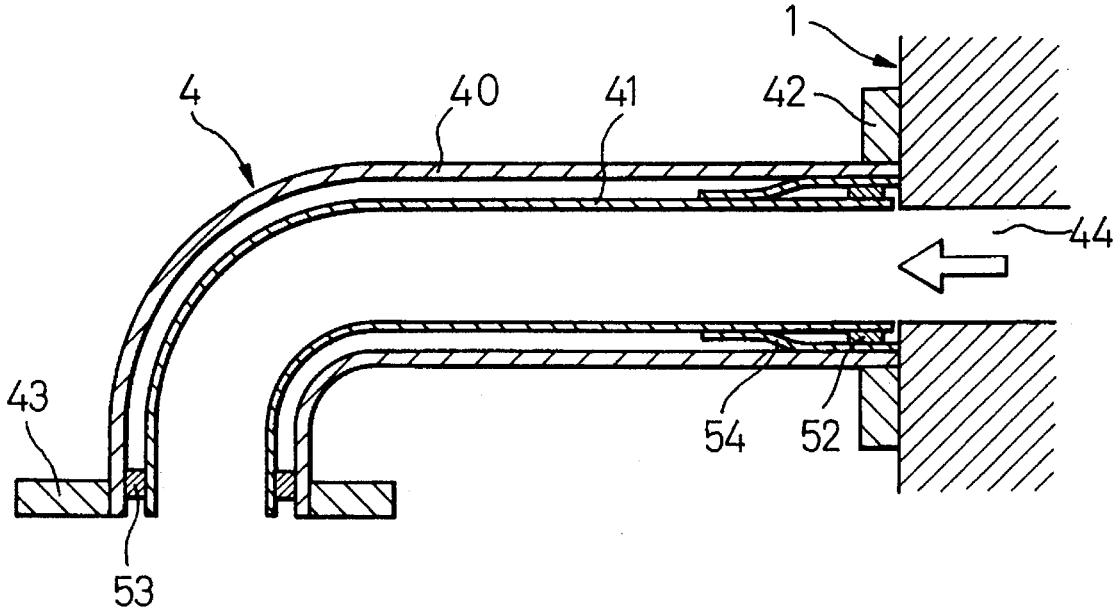
FIG. 19 is a cross-sectional side view of a fifth embodiment of an exhaust manifold.
Figure 20:
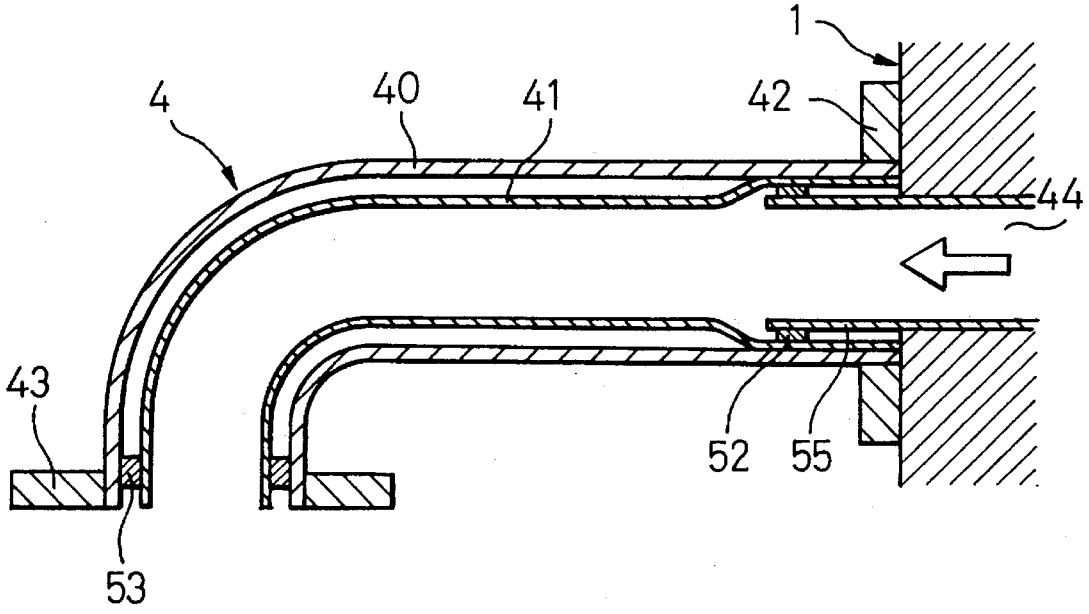
FIG. 20 is a cross-sectional side view of a sixth embodiment of an exhaust manifold.

FIGS. 18 through 20 illustrate cases where representive constructions among the double exhaust pipe constructions illustrated in FIGS. 6 through 14 are applied to the double exhaust pipe constructions of the exhaust manifold 4. Namely, in the embodiment illustrated in FIG. 18, the upstream end of the inner pipe of the inner casing 41 is fixed to the outer casing 40 by welding, and an exhaust gas guide pipe 51 is fixed to the upstream end portion of the inner pipe of the inner casing 41 by welding. An annular heat insulating retainer 52 made of wiremesh is inserted between the inner pipe of the inner casing 41 and the exhaust gas guide pipe 51, and the downstream end portion of the collecting portion of the inner casing 41 is supported by the outer casing 40 via an annular heat insulating retainer 53 made of wiremesh.

In the embodiment illustrated in FIG. 19, the upstream end portion of the inner pipe of the inner casing 41 is supported by the outer casing 40 via a tubular supporting member 54, and the upstream end of the support member 54 is fixed to the outer casing 40 by welding. In the embodiment illustrated in FIG. 20, an exhaust gas guide pipe 55 is fitted into the exhaust port 44, and the upstream end portion of the exhaust gas guide pipe 55 is arranged to project into the upstream end portion of the inner pipe of the inner casing 41.

Next, a method of manufacturing the inner pipe and the outer pipe of the double exhaust pipe and, particularly, the inner pipe of the double exhaust pipe will be explained. The inner pipe of the double exhaust pipe is normally formed in the following manner. Namely, initially, a flat plate is bent in the form of a U shape and then bent in the form of an O shape. After this, the opposed ends of the bent plate are caused to abut against each other and then are welded to each other. However, it is difficult to precisely align the opposed ends of the bent plate and, if the opposed ends of the bent plated are not aligned with each other, the welding operation of the opposed ends of the bent plate is difficult. Therefore, it is required that the opposed ends of the bent plated can be correctly welded even if the positions of the opposed ends of the bent plate are not aligned with each other.

Figure 21:
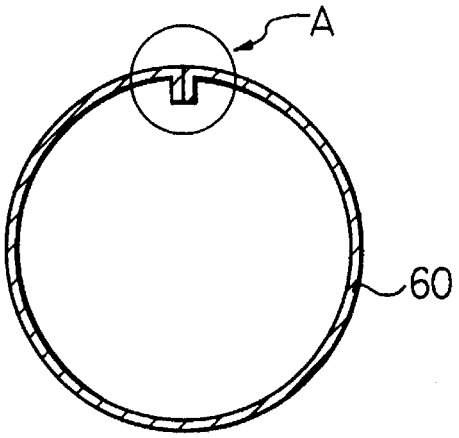
FIG. 21 is a view for illustrating a method of manufacturing the inner pipe.
Figure 22A:
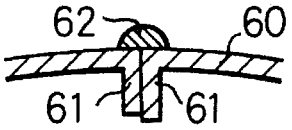
FIGS. 22A through 22L are views illustrating various examples of the welded portion.
Figure 22B:
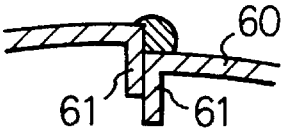

FIG. 21 illustrates the state where a flat plate 60 is bent in the form of an O shape, and then the opposed ends of the bent plate 60 are caused to abut against each other. FIGS. 22A and 22B illustrate an enlarged view of the portion A in FIG. 21. In the example illustrated in FIGS. 21, 22A and 22B, the opposed ends 61 of the plate 60 is bent approximately at a right angle. Initially, the opposed ends 61 of the plate 60 are caused to abut against each other and then welded to each other as illustrated by reference numeral 62. In this case, when the opposed ends 61 of the plate 60 are caused to abut against each other, even if the opposed ends 61 of the plate 60 are not aligned with each other as illustrated in FIG. 22B, the opposed ends 61 can be correctly welded to each other. In addition, if the opposed ends 61 of the plated 60 are bent approximately at a right angle, since the rigidity of the welded portion becomes high, it is possible to increase the strength of the inner pipe. Note that the opposed ends 61 are bent toward the inside of the inner pipe to prevent the opposed ends 61 from interfering with the outer pipe.

Figure 22C:
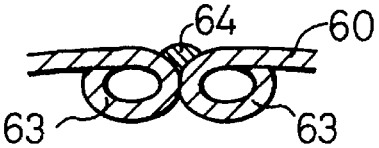
Figure 22D:
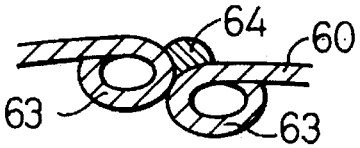

FIGS. 22C and 22D illustrate the case where the opposed ends 63 of the plate 60 are formed in the shape of a loop, and the loop shaped opposed ends 63 are welded to each other, as illustrated by reference numeral 64. FIG. 22D illustrates the case where the opposed ends 63 are not aligned with each other.

Figure 22E:
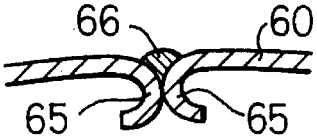
Figure 22F:
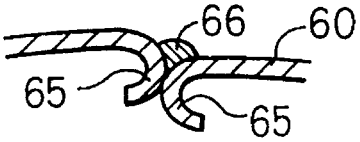

FIGS. 22E and 22F illustrate the case where the opposed ends 65 of the plate 60 are bent in the form of an arc shape, and the arc shaped opposed ends 65 are welded to each other, as illustrated by reference numeral 66. FIG. 22F illustrates the case where the arc shaped opposed ends 65 are not aligned with each other.

Figure 22G:
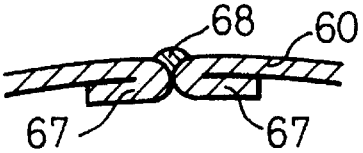
Figure 22H:
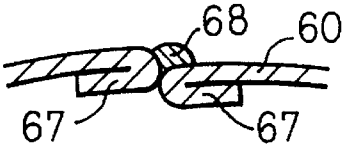

FIGS. 22G and 22H illustrate the case where the opposed ends 67 of the plate 60 are folded through 180 degrees, and the folded opposed ends 67 are welded to each other, as illustrated by reference numeral 68. FIG. 22H illustrates the case where the folded opposed ends 67 are not aligned with each.

Figure 22I:
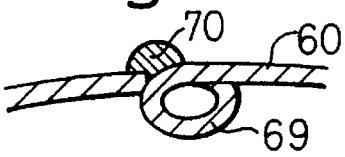
Figure 22J:
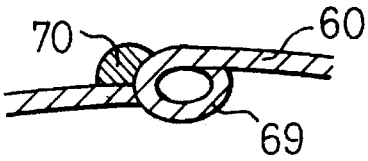

FIGS. 22I and 22J illustrate the case where one of the opposed ends 69 is formed in the shape of a loop, and the loop shaped end 69 is welded to the other end at which the bending operation is not carried out, as illustrated by reference numeral 70. FIG. 22J illustrates the case where the opposed ends of the plates 60 are not aligned with each other.

Figure 22K:
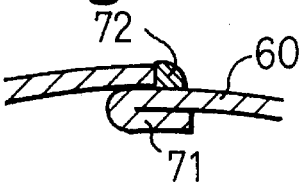

FIG. 22K illustrates the case where one of the opposed ends 71 of the plate 60 is folded at 180 degrees, and the other end of the plate 60, at which the folding operation is not carried out, is welded to the outer circumferential face of the folded end 71, as illustrated by reference numeral 72.

Figure 22L:
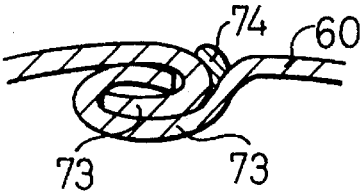

FIG. 22L illustrates the case where the opposed ends 73 of the plate 60 are formed in the form of a hook shape so that they can be hooked with each other, and the hook shaped opposed ends 73 are welded to each other, as illustrated by reference numeral 74.

Figure 23A:
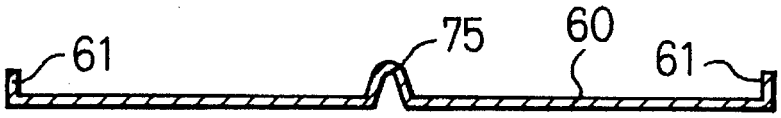
FIGS. 23A and 23B are views for illustrating another method of manufacturing the inner pipe.
Figure 23B:
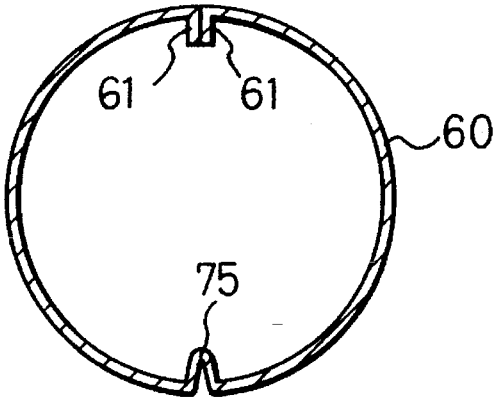

FIG. 23A illustrates the case where the opposed ends 61 of the flat plate 60 are bent at a right angle, as described in the manner as the example illustrated in FIGS. 22A and 22B and, in addition, a wedge shaped folded portion 75 is formed at the central portion of the plate 60. If the inner pipe is formed from this plate 60, two reinforced portions 61, 75 are formed, and thus, it is possible to increase the rigidity of the inner pipe.

Figure 24:
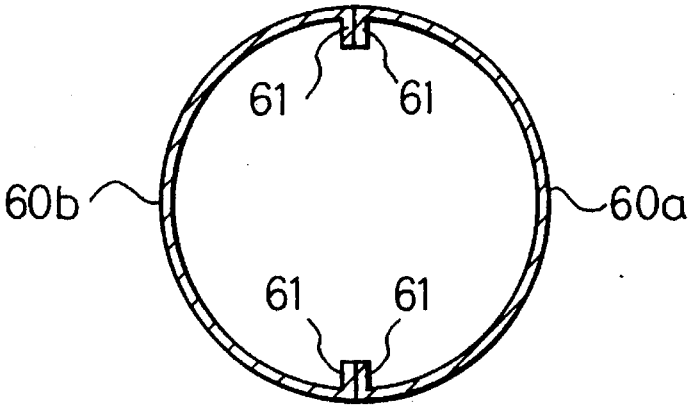
FIG. 24 is a view for illustrating a further method of manufacturing the inner pipe.

FIG. 24 illustrates the case where the plate is formed by a pair of plate halves 60*a*, 60*b*. The opposed ends 61 of each plate halves 60*a*, 60*b* are bent at a right angle, and the bent opposed ends 61 of the plate half 60*a* are welded to the corresponding bent opposed ends 61 of the plate half 60*b*.

According to the present invention, it is possible to prevent the temperature of only a particular portion of the outer pipe from becoming excessively high. As a result, since an outer pipe of low cost can be used, it is possible to reduce the manufacturing cost of the double exhaust pipe. In addition, since the dispersion of heat from the inner pipe can be sufficiently suppressed, it is possible to considerably suppress the reduction in the temperature of exhaust gas.

While the invention has been described by references to specific embodiments chosen for the purpose of illustration, it should be apparent that numerous modifications could be made thereto by those skilled in the art without departing from the basic concept and scope of the invention.

I claim:

1. An exhaust system for an engine having a plurality of exhaust ports formed therein, comprising an exhaust manifold having:

an outer casing and an inner casing arranged in and spaced from said outer casing, said inner casing having a collecting portion and a plurality of inner pipes which are branched off said collecting portion and are connected to said corresponding exhaust port;

a downstream end portion of said collecting portion being stationarily supported by said outer casing;

upstream end portions of said inner pipes being axially movably supported by and within said outer casing; and sealing means provided between said outer casing and each inner pipe for preventing exhaust gas from flowing into a space between said outer casing and each inner pipe;

wherein the upstream end portions of said inner pipes have a bellows shape and are continuously urged onto an outer side wall of the engine around said corresponding exhaust ports, and said sealing means is formed by said bellows-shaped upstream end portions of said inner pipes.

2. An exhaust system for an engine having a plurality of exhaust ports formed therein, comprising an exhaust manifold having:

an outer casing and an inner casing arranged in and spaced from said outer casing, said inner casing having a collecting portion and a plurality of inner pipes which are branched off said collecting portion and are connected to said corresponding exhaust port, a downstream end portion of said collecting portion being stationarily supported by said outer casing, and upstream end portions of said inner pipes being axially movably supported within said outer casing, wherein exhaust gas guide pipes are provided for guiding an exhaust gas from the exhaust ports to said corresponding inner pipes, and upstream end portions of said exhaust gas guiding pipes are fitted into the corresponding exhaust ports, the upstream end portions of said inner pipes being movably supported by downstream end portions of said corresponding exhaust gas guide pipes, the upstream end portions of the inner pipes making sealing contact with the downstream end portions of the exhaust gas guide pipes.

3. An exhaust system according to claim 2, wherein sealing means is provided between said inner pipes and said corresponding exhaust gas guide pipes for preventing an exhaust gas from flowing into a space between said outer casing and each inner pipe.

4. An exhaust system according to claim 3, wherein said sealing means is made of wire mesh inserted between said inner pipes and said corresponding exhaust gas guide pipes.

5. An exhaust system according to claim 3, wherein the downstream end portions of said exhaust gas guide pipes are bellows-shaped and form said seal means.

6. An exhaust system according to claim 2, wherein a downstream end portion of said collecting portion is fixed to said outer casing via tubular supporting member.

7. An exhaust system according to claim 6, wherein sealing means is provided between said tubular supporting member and the downstream end of said collecting portion.

8. An exhaust system according to claim 2, wherein a double exhaust pipe comprising an outer pipe and an inner pipe arranged in and spaced from said outer pipe is connected to an outlet of said exhaust manifold.

9. An exhaust system according to claim 8, wherein an upstream end portion of the inner pipe of said double exhaust pipe is stationarily supported by said outer pipe, and a downstream end portion of the inner pipe of said double exhaust pipe is axially movably supported within said outer pipe.

10. An exhaust system according to claim 9, wherein the downstream end portion of the inner pipe of said double exhaust pipe is axially movably supported by said outer pipe via sealing member.

11. An exhaust system according to claim 10, wherein said sealing member is made of wire mesh.

12. An exhaust system according to claim 9, wherein the upstream end of the inner pipe of said double exhaust pipe is fixed to said outer pipe welding.

13. An exhaust system according to claim 12, wherein an exhaust gas guide pipe is arranged in and spaced from the upstream end of the inner pipe of said double exhaust pipe, and the downstream end portion of said exhaust gas guide pipe is supported by the inner pipe of said double exhaust pipe.

14. An exhaust system according to claim 13, wherein a seal member is inserted between said exhaust gas guide pipe and the upstream end portion of the inner pipe of said double exhaust pipe.

15. An exhaust system according to claim 14, wherein said seal member is made of wire mesh.

16. An exhaust system according to claim 9, wherein the upstream end portion of the inner pipe of said double exhaust pipe is supported by said outer pipe via a tubular supporting member, and the upstream end of said tubular supporting member is fixed to said outer pipe by welding.

17. An exhaust system according to claim 16, wherein a seal member is inserted between said tubular supporting member and the upstream end portion of the inner pipe of said double exhaust pipe.

18. An exhaust system according to claim 17, wherein said seal member is made of wire mesh.

19. An exhaust system according to claim 2, wherein the upstream end portions of said inner pipes are inserted around the downstream end portions of said corresponding exhaust gas guide pipes.

20. An exhaust system for an engine having a plurality of exhaust ports formed therein, comprising an exhaust manifold having:

an outer casing and an inner casing arranged in and spaced from said outer casing, said inner casing having a collecting portion and a plurality of inner pipes which are branched off said collecting portion and are connected to said corresponding exhaust port;

a downstream end portion of said collecting portion being stationarily supported by said outer casing; and upstream end portions of said inner pipes being axially movably supported by and within said outer casing; and a double exhaust pipe having an outer pipe and an inner pipe arranged in and spaced from said outer pipe is connected to an outlet of said exhaust manifold; and a seal member inserted between said tubular supporting member and the upstream end portion of the inner pipe of said double exhaust pipe;

wherein the upstream end portion of the inner pipe of said double exhaust pipe is stationarily supported by said outer pipe via a tubular supporting member, the upstream end of said tubular supporting member being fixed to said outer pipe by welding, and a downstream end portion of the inner pipe of said double exhaust pipe is axially movably supported within said outer pipe.

* * * * *

UNITED STATES PATENT AND TRADEMARK OFFICE

CERTIFICATE OF CORRECTION

PATENT NO. : 5,606,857

DATED : March 4, 1997

INVENTOR(S) : Kenichi HARADA

It is certified that error appears in the above-indentified patent and that said Letters Patent is hereby corrected as shown below:

Column 2, line 18, change "a eighth" to --an eighth--.

Column 5, line 7, after "portion" insert --of--.

Column 5, line 8, delete "of".

Column 5, line 32, change "3t" to --31--.

Column 7, line 20, change "plated" to --plate--.

Column 7, line 44, after "each" insert --other.--.

Column 9, line 12, after "via" insert --a--.

Column 9, line 29, after "via" insert --a--.

Signed and Sealed this

Ninth Day of December, 1997

*Attest:*

Bruce Lehman

BRUCE LEHMAN

*Attesting Officer*

*Commissioner of Patents and Trademarks*